United States Patent [19]

Petzold et al.

[11] 4,090,845

[45] May 23, 1978

[54] PROCESS FOR THE DYEING OF POLYACRYLONITRILE FIBROUS MATERIAL

[75] Inventors: Manfred Petzold; Heinz Grunert; Wolfgang Rupilius, all of Dusseldorf; Horst Rutzen, Langenfeld, all of Germany

[73] Assignee: Henkel Kommanditgesellschaft auf Aktien, Dusseldorf-Holthausen, Germany

[21] Appl. No.: 750,727

[22] Filed: Dec. 15, 1976

[30] Foreign Application Priority Data

Dec. 15, 1975 Germany ..... 2556376

[51] Int. Cl.[2] ..... D06P 5/04; C07C 85/00

[52] U.S. Cl. ..... 8/169; 8/14 XB; 8/41 A; 8/84; 8/88; 8/168 AA; 8/172 R; 8/177 AB; 260/567.6 M; 260/567.6 P

[58] Field of Search ..... 8/168 AA, 168 AB, 168 AC, 8/169, 172 R, 177 AB, 84, 88

[56] References Cited

U.S. PATENT DOCUMENTS

| | | | |
|---|---|---|---|
| 2,953,526 | 9/1960 | Bergman et al. | 252/8.8 |
| 3,755,435 | 8/1973 | Sundby et al. | 260/534 M |
| 3,869,250 | 3/1975 | Wegmuller et al. | 8/15 |
| 3,872,116 | 3/1975 | Gipson | 260/247.7 A |
| 3,945,794 | 3/1976 | Rokohl et al. | 8/172 R |

FOREIGN PATENT DOCUMENTS

| | | |
|---|---|---|
| 67-10,729 | 6/1967 | Japan. |

OTHER PUBLICATIONS

Peters, R. H., "Textile Chemistry" vol. III, (Elsevier), 1975, pp. 874–878.

*Primary Examiner*—A. Lionel Clingman
*Attorney, Agent, or Firm*—Hammond & Littell

[57] ABSTRACT

Water-soluble quaternary ammonium compounds of the formula:

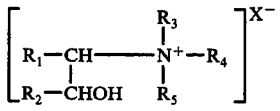

wherein $R_1$ and $R_2$ are each alkyl groups of $C_{1-15}$ chain length wherein the sum of the carbon atoms in said groups is 9 to 18; $R_3$ represents a $C_{1-5}$ alkyl or hydroxyalkyl group; $R_4$ represents a $C_{1-5}$ alkyl, hydroxyalkyl or benzyl group; $R_5$ represents a benzyl group; and X represents a salt-forming anion, are effective retardant-levelling agents in the dyeing of anionic polyacrylonitrile fibers with basic (i.e. cationic) dyes.

19 Claims, No Drawings

PROCESS FOR THE DYEING OF POLYACRYLONITRILE FIBROUS MATERIAL

FIELD OF THE INVENTION

The present invention relates to an improved process for the dyeing of polyacrylonitrile fibrous material by means of basic dyestuffs employing water-soluble ammonium compounds as retarding and levelling agents.

BACKGROUND OF THE INVENTION

The problems arising during the dyeing of polyacrylonitrile fibers and materials having a content thereof with cationic dyestuffs are known. Owing to their basic character, the cationic dyestuffs have a great affinity for polyacrylonitrile fibers (which are usually anionic), but they attach themselves non-uniformly thereto. This disadvantage becomes apparent particularly when it is desired to dye the fibers with bright tints. The resulting dyeing have a non-uniform or non-level appearance, which renders them unsatisfactory.

In order to obtain more uniform or level dyeings, attempts have been made to decrease the speed of absorption of the dyestuffs by careful temperature control or by addition of retardants, i.e., quaternary ammonium salts which contain higher linear or only slightly branched fatty chains, such as alkylpyridinium salts or fatty alkyltrimethyl or fatty alkylbenzyldimethyl ammonium salts. However, the achievement of level dyeings by retardation of the rate or speed of dyeing is extremely time-consuming. Moreover it is unreliable, because the aids used hitherto have only a specific effect and therefore have a relatively small range of application.

OBJECTS OF THE INVENTION

An object of the invention is to provide a new method for use in the dyeing of anionic polyacrylonitrile fibers with basic (i.e. cationic) dyes, which will provide dyeing of superior levelness without requiring dyers to learn any new technique.

THE INVENTION

The discovery has now been made that the foregoing objects are substantially attained when the dye bath has a dissolved content of a quaternary ammonium salt of the formula:

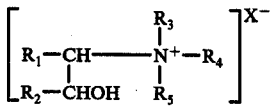

wherein $R_1$ and $R_2$ represent alkyl groups of $C_{1-15}$ chain length wherein the sum of the carbon atoms in said groups is 9 to 18; $R_3$ represents a $C_{1-5}$ alkyl or hydroxyalkyl group; $R_4$ represents a $C_{1-5}$ alkyl, hydroxyalkyl or benzyl group; $R_5$ represents a benzyl group; and $X^-$ represents a salt-forming anion, the ratio of said dye to said quaternary ammonium salt being between 1:10 and 10:1 by weight. We have found that these salts act as retardants of the speed of the dyeing and as levellers of the dye absorbed, and that in these ways they produce dyeings of superior uniformity.

We have further found that the preferred quaternary ammonium salts are those in which $R_3$ and/or $R_4$ represent methyl and $X^-$ represents $Cl^-$, and which the sum of the chain represented by $R_1$ and $R_2$ possess the following distribution as to their length:

| Carbon Atoms in $R_1$ and $R_2$ | | |
|---|---|---|
| No. | | % by Weight |
| 13 | = | 25 |
| 14 | = | 25 |
| 15 | = | 30 |
| 16 | = | 15 |

These quaternary ammonium salts compounds regulate the speed of absorption of the dyestuffs and provide substantial improvement in levelness even in difficult cases without significantly retarding the rate at which the polyacrylonitrile fibers are dyed.

The invention is thus an improvement in the dyeing of a material having a content of an anionic polyacrylonitrile fiber, wherein the material is contacted with an aqueous dye bath containing a cationic dye and said dye is substantively absorbed by said fiber. The improvement comprises providing said bath with a content as retardant and levelling agent for said dye an effective amount of water-soluble quaternary ammonium salt of the formula given above.

The invention rests on our discovery that the aforesaid dye both provides dyeings of superior levelness without a significant sacrifice in the speed at which the fiber is dyed.

Accordingly, we have found that aqueous dye baths which comprise an aqueous solution of one or more cationic dyes provide more level dyeings of anionic polyacrylonitrile fibers when they have a dissolved content of one or more of the above-identified quaternary ammonium salts.

The quaternary ammonium salts used in the process of the present invention may be prepared by known methods. By way of example, an internal mono-olefin of $C_{11-20}$ chain length, the double bonds of which are stastically distributed along the hydrocarbon chain but are not terminal, is reacted with an epoxidizing agent such as a peracetic acid with formation of the corresponding chain epoxide, after which the corresponding hydroxyamine derivative of the following general formula is formed by reaction with ammonia or amines, preferably with lower secondary amines such as dimethyl-, diethyl-, or diethanolamine:

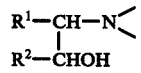

(II)

wherein $R^1$ and $R^2$ have the meanings given above. Quaternary ammonium salts suitable for use in accordance with the present invention are obtained by quaternizing these tertiary amines with an alkylating agent (preferably a benzyl halide). The manufacture of compounds of formula II is described in U.S. Pat. Application Ser. No. 683,319, filed May 5, 1976 and in Japanese Patent publication No. 10 729/67.

The above described quaternary ammonium salts are soluble in water to the extent of at least 5% by weight. They are preferably used in concentrations of from 0.25 to 2% based on the weight of the fiber, and the quantity used can extend on either side of these limits. No difficulty is caused by the addition of other salts such as sodium sulfate and sodium chloride which are customarily used in such dyeing baths.

The process of the present invention is usefully employed in connection with wide variety of cationic dyestuffs, for example the diphenylmethane, triphenylmethane and rhodamine dyes, as well as the oxazine, thiazine, diazine, indoline and cyanine dyes, the basic azo and azomethine dyes and the like.

The process of the present invention is useful in the dyeing of fibers, threads, knitted fabrics, textile fabrics, felts, fleeces, carpets and the like made from polyacrylonitrile or copolymers containing acrylonitrile; the materials which are dyed may contain other natural or synthetic fibrous material. The material dyed can be in the form of tow, combed silver, flock, spun, continuous filament, yarn, cross wound, wound bobbin or in some other form intended for further processing into textile (i.e. woven)form.

The polyacrylonitrile fibers which are benefited by the present invention during dyeing are those which have a content of at least 75% (and preferably 90–95% by weight) of (meth)acrylonitrile units. The remaining units of the polymer are typically ester units (for example methyl or ethyl acrylate or vinyl acetate), alcohol units (for example vinyl alcohol units), and acrylic acid or sulfostyrene units (which render the polymer immediately substantive to cationic dyes by provision of carboxy and sulfo groups). When the polymer as made contains substantially no acid(i.e., anionic) units (as when the fiber is composed of homopolymerized acrylonitrile), such units tend to develop during the dyeing operation by hydrolysis of a portion of the nitrile groups which are present. Such fibers are likewise benefited by the present invention. In other instances nonionic fibers which carry hydrolyzable ester or amide substituents (fibers containing e.g. ethyl acrylate, acrylamide, and vinylbenzamide units are benefited by the process of the present invention because these substituents hydrolyze at least in part during dyeing and thereby provide anionic substituents.

The anionic substituents of polyacrylonitrile fibers need not be uniformly distributed throughout the fiber but can be located on the surface, as is the case when the fiber is subjected to a short hydrolysis treatment during the fiber-forming operation. The anionic substituents thus provided are carboxy substituents.

The aforesaid polyacrylonitrile fibrous materials can be dyed according to the present invention by any of the heretofore known standard methods. Thus standard apparatus (e.g. winch vats, cross wound bobbin dyeing apparatus, beam dyeing apparatus, hank yarn dyeing apparatus, flock dyeing apparatus, sliver dyeing apparatus, carpet dyeing apparatus, and apparatus for package dyeing, and drum and paddle system apparatus can be used. The apparatus can be adapted for continuous dyeings.

Dye baths according to the present invention are formed by dissolving one or more water-soluble cationic dyes in a body of water together with one or more of the cationic retardant-levelling agents described above. Other agents as are commonly present in cationic dye baths (wetting agents, fluorescing agents, antibiotics, etc.) can be added if desired. During bath dyeing the weight of the cationic components in bath decreases. In continuous dyeing processes the concentration of dyes and supplementary agents in the bath is maintained substantially constant by periodic addition of make-up solution. The baths advantageously have an acidic pH (in the range of 4,0 to 6,5) and are cationic, and are used in the temperature range of 40° C. to 106° C.

The dye component is present in the bath in predetermined amount sufficient to provide the desired depth of shade. This varies from instance to instance depending chiefly on the tinctorial power of the dye, the specific color of the dye, and the affinity of the fiber for the dye. In general the amount is in the range of 0,5 parts to 5000 parts per million parts by weight of bath liquor, or 0,001% to 5,0% on the weight of the fabric to be dyed therein.

The retardant-levelling agent component of the present invention is present in the dyebath in an amount which is effective to cause a significant improvement in the levelness of the dyeing effected. For this purpose the levelling agent component is present in a proportion between about 1:10 and 10:1 based on the weight of the dye component present. In practice we have found that it is better or have too much leveller present rather than too little and consequently we prefer the weight of the levelling agent at the start of the dyeing operation to be between 1 and 8 times the weight of the dye (or mixture of dyes). All the agent needed can be added at the start of the dyeing, or the appropriate amount can be added in increments as the dyeing proceeds.

The present invention is further illustrated by the following examples. These examples represent best embodiments of the invention and are not to be construed in limitation thereof.

EXAMPLE 1

The following illustrates the preparation of a dye bath according to the present invention and the dyeing of an anionic polyacrylonitrile fiber therein.

(a) A dyeing operation was carried out in a hank yarn dyeing apparatus on an ionically modified polyacrylonitrile yarn in a yarn: liquor weight ratio of 1:25. The dye bath contained at the start, based on the weight of the yarn:

| Component | % on Yarn |
|---|---|
| Astrazon Yellow 7 GLL® | 0.15 |
| Astrazon Red GTL® | 0.10 |
| Astrazon Blue 5 GL® | 0.15 |
| Acetic acid, 30% | 4.0 |
| Adduct of mixed fatty alcohols ($C_{12-18}$ chain length, iodine No. 45 to 50) with ethylene oxide (1:35 molar ratio) | 0.2 |
| Retarder-leveller No. 1 (see below) | 1.0 |

The weight ratio of the dye to the leveler compound was 0.35:1, equivalent to 1:2.85.

The bath was heated to 98° C. within 30 minutes commencing at 75° C. and the material was dyed for 15 minutes at this temperature, then cooled and rinsed.

Retarder-leveller No. 1 corresponds to the compound of formula (I), wherein $R^1 + R^2 = C_{9-12}$, $R_3 = CH_3$, $R^4 = CH_3$, $R^5 = -CH_2C_6H_5$ and $X^- = Cl-$. The compound thus has the formula

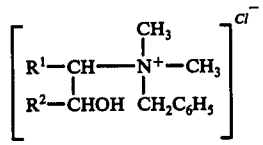

wherein $R^1$ and $R^2$ taken together are alkyl substituents containing 9 to 12 carbon atoms.

(b) A dyeing was carried out in the same manner with the same bath for the purpose of comparison, except that 1.0% of dodecyltrimethyl ammonium chloride was used instead of the leveller shown above.

The dyeings showed that retarder leveller No. 1 provided a distinctly stronger retarding action and a more uniform dyeing than that provided by the quaternary ammonium compound of dye bath (b).

EXAMPLE 2

The following shows the effectiveness of a different retarder-leveller, used in substantially smaller proportion.

(a) A dyeing was carried out in the same apparatus as was used in Example 1, using an anionically modified polyacrylonitrile yarn (Nm 40/2), in a yarn: liquor ratio of 1:25. The dye bath contained at the start, based on the weight of the yarn to be dyed:

| Component | % on Yarn |
|---|---|
| Maxilon Blue GL® | 1.0 |
| Astramalachite Green RXY® | 0.1 |
| Acetic acid, 30% | 4.0 |
| Retarder-leveller No. 2 (see below) | 1.0 |

The weight ratio of the retardant-leveller to the dyes was 1:1.1.

The dye bath was heated from 25° - 30° C. to 75° to 80° C. within 6 to 8 minutes, and the temperature was then increased from 80° C. to 98° C. over a period of 35 to 40 minutes. After 15 minutes at 98° C. the yarn was cooled and rinsed.

Retarder-leveller No. 2 correponded to the general formula (I), wherein the total $R^1 + R^2 = C_{13-16}$, $R^3$ and $R^4 = -CH_3$, $R^5 = -CH_2C_6H_5$, and $X^- = Cl^-$.

The compound thus has the formula

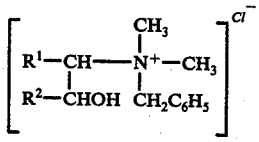

wherein the sum of the carbon atoms is $R^1 + R^2$ is 13–16.

(b) A dyeing operation was carried out with the same formulation for the purpose of comparison, 1.0% of lauryl dimethyl benzyl ammonium choride being used instead of retarder-leveller No. 2.

Dyeing (a) showed that the quaternary ammonium agent used therein provided a distinctly stronger retarding action that the quaternary ammonium agent used in dyeing (b)and provided satisfactory uniformity in the dyeing result without significant loss of speed.

EXAMPLE 3

The following illustrates a dyeing with a more dilute dye bath wherein the retarder-leveller is present in intermediate ratio with respect to the dye.

A dyeing was carried out in a dyeing apparatus with the yarn of Example 2, the yarn: the liquor ratio being 1:50. The dye bath contained, based on the weight of the yarn:

| Component | % on Yarn |
|---|---|
| Astrazon Blue RL® | 0.5 |
| Acetic acid 60% | (1.5 ml./1.) |
| Retarder-leveller No. 3 (see below) | 2.0 |

Here the ratio of the retarder-leveller to the dye component was 4:1.

The formula of the compound is the same as that of Example 2, except that X is $CH_3SO_4^-$.

The yarn was introduced into the dye bath at 60° C. and the temperature of the bath was than increased to 98° C. A sample of the yarn was removed when the bath reached 98° C. and further samples were removed at 98° C. after 15 and 30 minutes.

For the purpose of more clearly illustrating the retarding action of the agent another exhaustive dyeing was then carried out with the dye bath which had run for 15 minutes at 98° C. i.e. fresh yarn was introduced into this bath and was dyed for 30 minutes at 98° C. and, as is customary, was rinsed after cooling.

It was clearly evident that leveller No. 3 provided a very good retarding action leveller in this instance as well.

EXAMPLE 4

The following illustrates a dyeing with a similarly dilute bath wherein the leveller: dye ratio is high.

(a) A dyeing was carried out in a laboratory dyeing apparatus with a high-swelling anionic polyacrylonitrile yarn, the yarn: liquor ratio being 1:50. The dye bath contained based on the weight of the yarn:

| Component | % on Yarn |
|---|---|
| Astrazon Blue FGL® | 0.15 |
| Astrazon Blue 6 B® | 0.04 |
| Astrazon Yellow 7 GLL® | 0.03 |
| Acetic acid, 60% | (1.5 ml./1.) |
| Retarder-leveller No. 4 (see below) | 2.0 |

Dyeing conditions: as given in Example 3. The weight ratio of the retarder-leveller to the mixture of dyes was 9.1:1.

Retarder-leveller No. 4 was the compound of formula (I) wherein the sum of $R^1 + R^2$ was $C_{13-16}$; $R^3 = -CH_3$, $R^4 = -CH_2CH_2OH$; $R^5 = -CH_2C_6H_5$; and $X^- = Br^-$.

The compound therefore had the formula

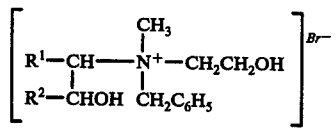

wherein the sum of the carbon atoms in $R^1$ and $R^2$ was 13–16.

(b) A dyeing was carried out in the same manner with the same formulation except that, for purposes of comparison, 2.0% of a mixture of $C_{12-16}$ - alkylpyridinium chlorides was used instead of leveller No. 4.

The result corresponded to that of Example 1, i.e. dye bath (a) showed that the quaternary ammonium compound therein provided a distinctly stronger retarding action than the alkylpyridinium chloride of dye bath (b) and provided a dyeing of substantially improved uniformity and levelness without a significant increase in the time required.

We claim:

1. In the dyeing of a fibrous material having a content of an anionic polyacrylonitrile fiber, wherein said material is contacted with an aqueous dye bath containing a cationic dye and said dye is substantively absorbed by said fiber, the improvement which comprises providing said bath with a content as retardant for the dyeing and as levelling agent for said dye of a water-soluble quaternary ammonium salt of the formula:

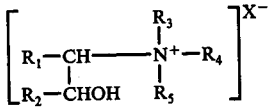

wherein $R^1$ and $R^2$ each represent alkyl groups of $C_{1-15}$ chain length wherein the sum of the carbon atoms in said groups is 9 to 18; $R^3$ represents a $C_{1-15}$ alkyl or hydroxyalkyl group; $R^4$ represents a $C_{1-5}$ alkyl, a $C_{1-5}$ hydroxylakyl or a benzyl group; $R^5$ represents a benzyl group; and X represents a salt-forming anion.

2. A process according to claim 1 wherein the sum of the carbon atoms in $R^1$ and $R^2$ conforms to the following distribution:

| Carbon Atoms in $R^1 + R^2$ | |
|---|---|
| No. | % by Wt. |
| 13 | 25 |
| 14 | 30 |
| 15 | 30 |
| 16 | 15 |

and $R^3$ represents $—CH_3$.

3. A process according to claim 2 wherein $R^4$ represents methyl.

4. A process according to claim 3 wherein X represents $Cl^-$.

5. A process according to claim 1 wherein the quaternary ammonium salt has the formula:

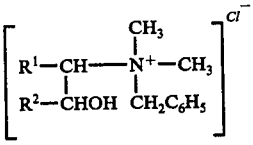

wherein $R^1$ and $R^2$ are alkyl where the sum of the carbon atoms is from 9 to 12.

6. A process according to claim 1 wherein the quaternary salt has the formula:

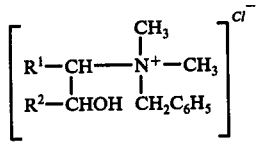

wherein $R^1$ and $R^2$ are alkyl where the sum of the carbon atoms is from 13 to 16.

7. A process according to claim 1 wherein the quaternary ammonium salt has the formula:

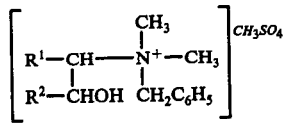

wherein $R^1$ and $R^2$ are alkyl wherein the sum of the carbon atoms is from 13 to 16.

8. A process according to claim 1 wherein the quaternary ammonium salt has the formula:

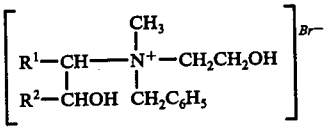

wherein $R^1$ and $R^2$ are alkyl where the sum of the carbon atoms is from 13 to 16.

9. A process according to claim 1 wherein the cationic dye is selected from the group consisting of diphenylmethane, triphenylmethane, rhodamine, oxazine, thiazine, diazine, indoline, cyanine, basic azo and azo methine dyes.

10. A process according to claim 1 wherein said quaternary amminium salt is present in said baths at the start of said dyeing in amount between 0.25% and 2% of the weight of said fibrous material.

11. A process according to claim 1 wherein the weight ratio of said quaternary ammonium salt to said dye is between 1:10 and 10:1.

12. A process according to claim 1 wherein the weight ratio of said quaternary ammonium salt to said dye is between 1:1 and 8:1.

13. A process according to claim 1 wherein said bath has a pH between 4,0 and 6,5.

14. A process according to claim 1 wherein said fibrous material is in the form of monofilaments, threads, knitted fabrics, woven fabrics, fleeces or carpeting.

15. An anionic polyacrylonitrile fiber dyed by a process according to claim 1.

16. An aqueous dye bath adapted to dye anionic polyacrylonitrile fibrous material, comprising an aqueous solution of a cationic dye and a quaternary ammonium salt of the formula:

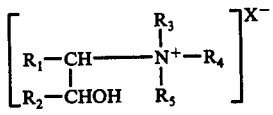

wherein $R^1$ and $R^2$ represent alkyl groups of $C_{1-15}$ chain length wherein the sum of the carbon atoms in said groups is 9 to 18; $R^3$ represents a $C_{1-5}$ alkyl or hydroxyalkyl group; $R^4$ represents a $C_{1-5}$ alkyl, or a $C_{1-5}$ hydroxyalkyl or a benzyl group; $R_5$ represents a benzyl group; and $X^-$ represents a salt-forming anion.

17. A dye bath according to claim 16 wherein the ratio of said dyes to said quaternary ammonium salt is between 1:10 to 10:1 by weight.

18. A dye bath according to claim 16 wherein said ratio is 1:1 to 1:8.

19. A bath according to claim 16 having an acid pH in the range of 4,0 to 6,5.

* * * * *